US009219340B2

(12) United States Patent
McSweyn et al.

(10) Patent No.: US 9,219,340 B2
(45) Date of Patent: Dec. 22, 2015

(54) CONNECTOR CABLE ASSEMBLY FOR MULTIPLE CONNECTORS

(71) Applicant: SCOSCHE INDUSTRIES, INC., Oxnard, CA (US)

(72) Inventors: Christopher McSweyn, Oxnard, CA (US); Vince Alves, Oxnard, CA (US)

(73) Assignee: Scosche Industries, Inc., Oxnard, CA (US)

( * ) Notice: Subject to any disclaimer, the term of this patent is extended or adjusted under 35 U.S.C. 154(b) by 223 days.

(21) Appl. No.: 13/912,477

(22) Filed: Jun. 7, 2013

(65) Prior Publication Data

US 2014/0273644 A1 Sep. 18, 2014

Related U.S. Application Data

(60) Provisional application No. 61/801,740, filed on Mar. 15, 2013.

(51) Int. Cl.

| | |
|---|---|
| ***H01R 31/06*** | (2006.01) |
| ***H01R 27/00*** | (2006.01) |
| ***H01R 13/631*** | (2006.01) |
| ***H01R 35/02*** | (2006.01) |

(52) U.S. Cl.
CPC ..... *H01R 27/00* (2013.01); *H01R 13/631* (2013.01); *H01R 31/06* (2013.01); *H01R 35/02* (2013.01)

(58) Field of Classification Search
USPC ..... 439/628
See application file for complete search history.

(56) References Cited

U.S. PATENT DOCUMENTS

| | | | | |
|---|---|---|---|---|
| 7,473,141 | B2 * | 1/2009 | Liao | 439/638 |
| 8,348,685 | B2 * | 1/2013 | Liao et al. | 439/131 |

* cited by examiner

*Primary Examiner* — Jean F Duverne
(74) *Attorney, Agent, or Firm* — Arent Fox LLP

(57) ABSTRACT

Disclosed is a connector cable assembly for multiple connectors comprising a base plug, an adapter plug and first and second pivot arms, so that the base plug and the adapter plug are movable between electrically engaged and electrically disengaged positions. The base plug has a first end, a second end, and first and second opposing sides with a first connector disposed in the first end of the base plug. The adapter plug has a first end, a second end, and first and second opposing sides. A first reciprocal connector disposed in the first end of the adapter plug is configured to mate with the first connector. A second connector, different than the first connector, is electrically connected to the first reciprocal connector.

41 Claims, 4 Drawing Sheets

CONNECTOR CABLE ASSEMBLY FOR MULTIPLE CONNECTORS

RELATED APPLICATION

This invention claims priority to U.S. Provisional Patent Application Ser. No. 61/801,740, filed on Mar. 15, 2013, entitled CONNECTOR CABLE ASSEMBLY FOR MULTIPLE CONNECTORS, the entirety of which is incorporated by reference herein.

BACKGROUND OF THE INVENTION

1. Field of the Invention

The present invention relates to the mechanical and electrical arts. In particular, it relates to a connector cable assembly for a variety of connectors.

2. Description of the Related Art

Conventional connector cables require multiple separate connectors in order to be used with multiple different connectors. For example, a different adapter is generally required if a connector cable is to be used with a device having a USB connector or a 30 pin connector or a Lightning connector. It is a disadvantage of such cables that it is easy to lose, misplace or otherwise find unavailable a particular connector when it is needed. U.S. Pat. No. 7,473,141, to Liao, provides a solution to this problem by providing a single connector cable assembly to which multiple connectors remain physically attached, while they are electrically engaged and disengaged from one another There remains a definite need, however, for additional connector cable assemblies for multiple connectors that provide greater ease in electrically engaging the multiple connectors and provide greater stability both when the connectors are electrically engaged and when they are electrically disengaged.

SUMMARY OF THE INVENTION

An aspect of the invention is a connector cable assembly for multiple connectors comprising a base plug, an adapter plug and first and second pivot arms configured to move the base plug and the adapter plug between electrically engaged and electrically disengaged positions. The base plug has a first end, a second end, and first and second opposing sides with a first connector disposed in the first end of the base plug. The adapter plug has a first end, a second end, and first and second opposing sides. A first reciprocal connector disposed in the first end of the adapter plug is configured to mate with the first connector.

In some aspects, a second connector of a different style than the first connector is electrically connected to adapter plug. In some embodiments, the second connector is disposed on the first end of the adapter plug. In alternative embodiments, the second connector is flexibly connected to the adapter plug. For example, in some embodiments, the second connector is connected to the adapter plug with a flexible cable. And in some embodiments, the second connector is connected to the adapter plug with a flexible hinge, such as a flexible neck. The flexible neck can be comprised of any suitable material including, without limitation, thermoplastic elastomer plastics.

In one aspect, the first pivot arm is pivotally connected to the first side of the base plug and slidably connected to the first side of the adapter plug, while the second pivot arm is pivotally connected to the second side of the base plug and slidably connected to the first side of the adapter plug. In another aspect, the first pivot arm is pivotally connected to the first side of the adapter plug and slidably connected to the first side of the base plug, while the second pivot arm is pivotally connected to the second side of the adapter plug and slidably connected to the first side of the base plug.

In still another aspect, a connector cable assembly for multiple connectors comprises a base plug, a first adapter plug, a second adapter plug, a third adapter plug and first and second pairs of pivot arms, the pivot arms configured so that the base plug and the first adapter plug are movable between electrically engaged and electrically disengaged positions and the first adapter plug and the second adapter plug are movable between electrically engaged and electrically disengaged positions.

The base plug has a first end, a second end, and first and second opposing sides with a first connector disposed in the first end of the base plug. In some aspects, the first adapter plug has a first end, a second end, and first and second opposing sides with a first reciprocal connector configured to mate with the first connector disposed in the second end and a second connector of a different style than the first connector, disposed in first second end and electrically connected to the first reciprocal connector.

The second adapter plug has a first end, a second end, and first and second opposing sides, with a second reciprocal connector, configured to mate with the second connector, disposed in the second end of the second adapter plug. In some aspects, the second reciprocal connector and a third connector are both different than the first and second connectors.

And in some aspects, the third connector is electrically connected to the second reciprocal connector. In some embodiments, the third connector is disposed on the first end of the body portion of the adapter plug. In alternative embodiments, the second connector is flexibly connected to the adapter plug. For example, in some embodiments, the second connector is connected to the adapter plug with a flexible cable. And in some embodiments, the second connector is connected to the adapter plug with a flexible hinge, such as a flexible neck. The flexible neck can be comprised of any suitable material including, without limitation, thermoplastic elastomer plastics.

In some embodiments, the first pair of first and second pivot arms comprise a first pivot arm pivotally connected to the first side of the base plug and slidably connected to the first side of the first adapter plug and a second pivot arm pivotally connected to the second side of the base plug and slidably connected to the second side of the first adapter plug, whereby the base plug and the first adapter plug are movable between electrically engaged and electrically disengaged positions. The second pair of first and second pivot arms comprise a first pivot arm pivotally connected to the first side of the first adapter plug and slidably connected to the first side of the second adapter plug and a second pivot arm pivotally connected to the second side of the first adapter plug and slidably connected to the second side of the second adapter plug.

And in some embodiments, the first pair of first and second pivot arms comprise a first pivot arm pivotally connected to the first side of the first adapter plug and slidably connected to the first side of the base plug and a second pivot arm pivotally connected to the second side of the first adapter plug and slidably connected to the second side of the base plug, whereby the base plug and the first adapter plug are movable between electrically engaged and electrically disengaged positions. The second pair of first and second pivot arms comprise a first pivot arm pivotally connected to the first side of the second adapter plug and slidably connected to the first side of the first adapter plug and a second pivot arm pivotally connected to the second side of the first adapter plug and slidably connected to the second side of the first adapter plug, whereby the first adapter plug and the second adapter plug are movable between electrically engaged and electrically disengaged positions.

In some aspects, a second base plug connector, different than the first connector, is disposed in the second end of the base plug and electrically connected to the first connector. And in some aspects, the first connector, the second connector, the third connector, the second base plug connector are each a Lightning connector, a 30-pin connector, a USB connector, a DC plug, an audio terminal, a video terminal, an IEEE1394 connector, HDMI connector or an RJ-45 connector.

In some aspects, the first opposing side of the adapter plug further comprises a first channel slidably receiving the first pivot arm and the second opposing side of the adapter plug further comprises a second channel slidably receiving the second pivot arm. And in some aspects, the first opposing side of the base plug further comprises a first channel slidably receiving the first pivot arm and the second opposing side of the base plug further comprises a second channel slidably receiving the second pivot arm.

In some aspects, the first opposing side of the base plug further comprises a first channel slidably receiving the first pivot arm and the second opposing side of the base plug further comprise a second channel slidably receiving the second pivot arm of the first pair of pivot arms and the first opposing side of the first adapter plug further comprises a first channel slidably receiving the first pivot arm and the second opposing side of the first adapter plug further comprise a second channel slidably receiving the second pivot arm of the second pair of pivot arms.

In some aspects, a first side arm extends axially from the first opposing side at the second end of the adapter plug, where the first slide channel extends along the first side arm, and a second side arm extends axially from the second opposing side of the adapter plug, where the second slide channel extends along the first second arm. And in some aspects, a first side arm extends axially from the first opposing side at the second end of the base plug, where the first slide channel extends along the first side arm, and a second side arm extending axially from the second opposing side of the adapter plug, where the second slide channel extends along the first second arm. And in some further aspects, the first side arm extends axially from the first opposing side at the second end of the first adapter plug, where the first slide channel extends along the first side arm, and the second side arm extends axially from the second opposing side of the first adapter plug, where the second slide channel extends along the second side arm, and the first side arm extends axially from the first opposing side at the second end of the second adapter plug, where the first slide channel extends along the first side arm, and the second side arm extending axially from the second opposing side of the second adapter plug, where the second slide channel extends along the second side arm.

BRIEF DESCRIPTION OF THE DRAWINGS

The accompanying drawings, together with the specification, illustrate exemplary embodiments, and, together with the description, serve to explain the principles of these embodiments.

DETAILED DESCRIPTION OF THE PREFERRED EMBODIMENTS

Particular embodiments of the invention are described below in detail for the purpose of illustrating its principles and operation. However, various modifications may be made and the scope of the invention is not limited to the exemplary embodiments described below.

Figure 1:
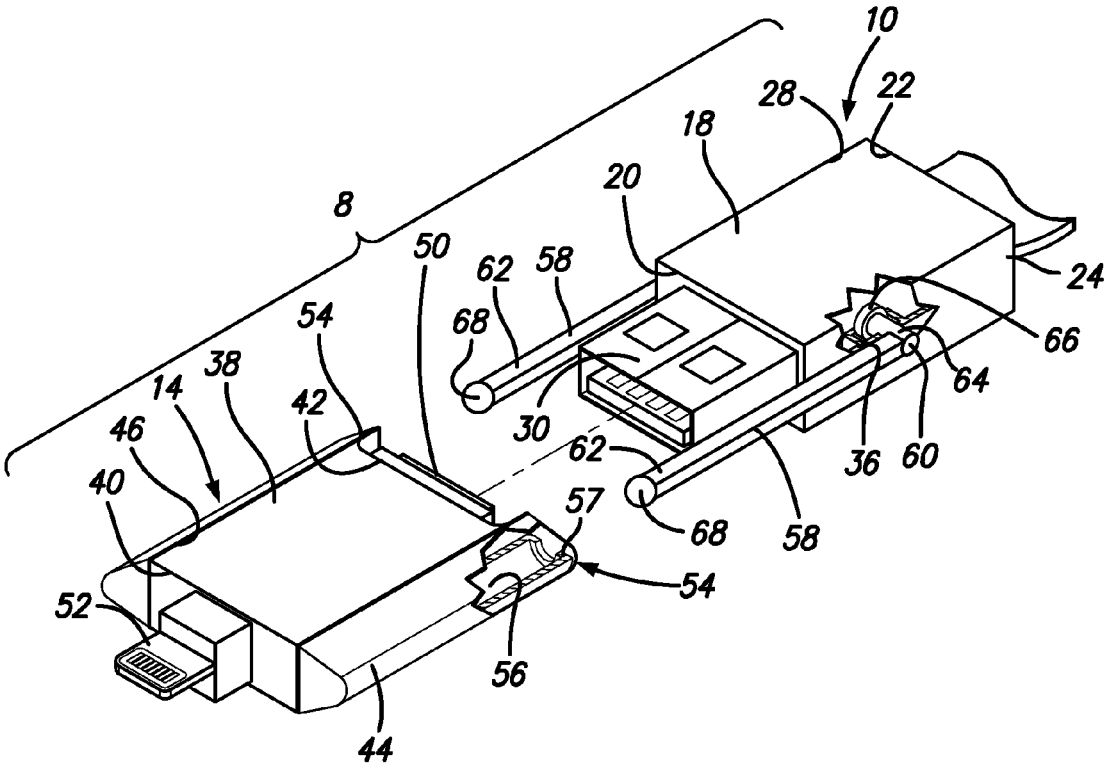
FIG. 1 is a partially broken away, exploded, perspective view of a first embodiment of a connector cable assembly in accordance with the invention.

Referring to FIG. 1, there is shown a partially broken away, exploded perspective view of a first embodiment of a connector cable assembly 8 in accordance with the invention. In this representative embodiment, the connector cable assembly includes a base plug 10 and an adapter plug 14.

The base plug 10 is made of any suitable material, including insulating materials, such as plastic. In the representative embodiment shown in FIG. 1, the base plug housing includes a housing 18 having a first end comprising a first end wall 20, a second end comprising a second end wall 22 and opposing sides comprising opposing side walls 24 and 28.

A first connector 30 is disposed at the first end 20 of the base housing 18. It is a distinct advantage of the invention, that the first connector can be any of a wide variety of styles of connectors. Representative connectors include, without limitation, Lightning connectors, 30-pin connectors, USB connectors, such as USB type A connectors, USB type B connectors, Mini USB connectors, and Micro USB connectors, DC plugs, audio terminals, video terminals, IEEE1394 connectors, HDMI (High-Definition Multimedia Interface) connectors, connectors for handheld electronic products (such as mobile phones or PDA's), RJ-45 connectors and the like. In the representative embodiment shown in FIG. 1, the first connector is a male USB Type-A connector.

Figure 2:
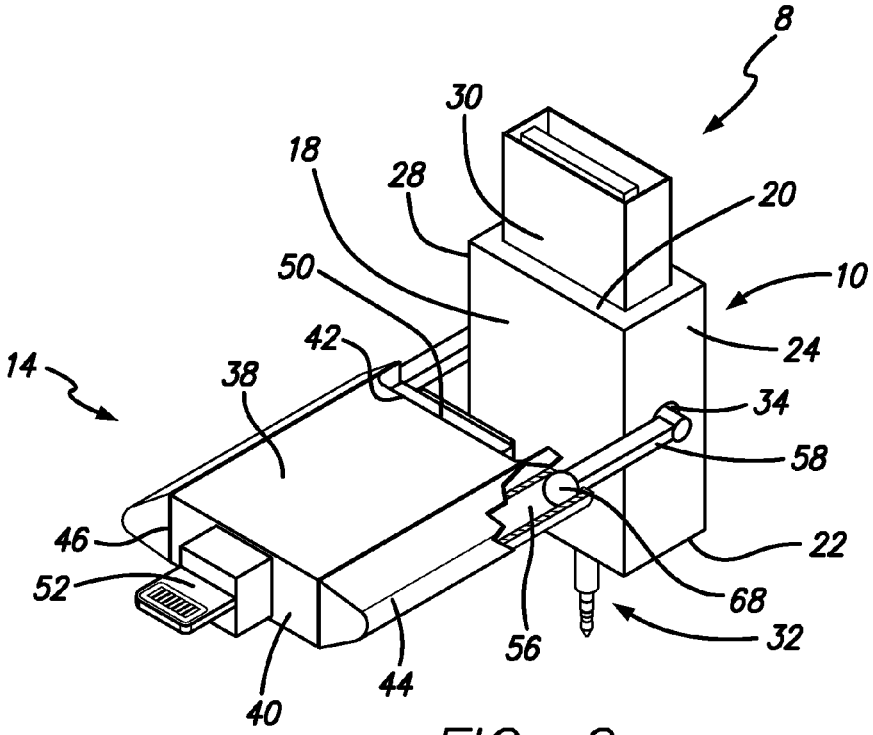
FIG. 2 is a partially broken away, perspective view of a second embodiment of a connector cable assembly in accordance with the invention in a disengaged position.

FIG. 2 is a perspective view illustrating an aspect of a connector cable assembly 8 in accordance with the invention. In some embodiments, a second base plug connector 32, of a different style than the first connector 30, is disposed at the second end 22 of the base housing 18. Representative connectors include, without limitation, Lightning connectors, 30-pin connectors, USB connectors, such as USB Type A connectors, USB Type B connectors, Mini USB connectors, and Micro USB connectors, DC plugs, audio terminals, video terminals, IEEE1394 connectors, HDMI (High-Definition Multimedia Interface) connectors, or connectors for handheld electronic products (such as mobile phones or PDA's), RJ-45 connectors and the like. In the representative embodiment shown in FIG. 2, the second base connector is a male 30 pin connector, while the first connector 32 is a male audio connector. The second connector is electrically connected to the first connector by any suitable means, including, without limitation, by circuit boards or terminals (not shown).

In some aspects, a pair of opposing pivot openings 34 (one shown), each having a circular cross section, is disposed in each of the opposing side walls 24 and 28. Aligned on the inner surface of each side wall with each pivot opening is a pivot head holder 36 also having a circular cross section, but with a diameter greater than the diameter of the pivot opening.

The adapter plug 14 is made of any suitable material, including insulating materials, such as plastic. In the representative embodiments shown in FIGS. 1 and 2, the adapter plug includes a housing 38 having a first end comprising a first end wall 40, a second end comprising a second end wall 42 and opposing sides comprising opposing side walls 44 and 46.

Figure 3:
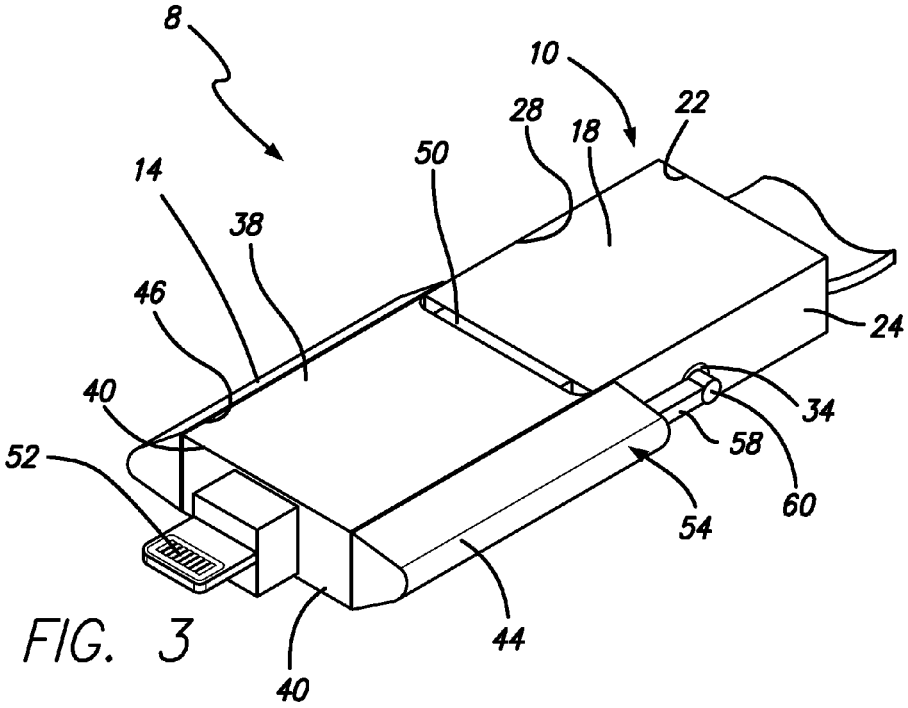
FIG. 3 is a perspective view of the connector cable assembly of FIG. 1 in an engaged position.

A first reciprocal connector 50 is disposed in the second end 42 of the housing 38 of the adapter plug 14. The first reciprocal connector is configured to mate with the first connector 30 to achieve an electrical connection when the base plug and the adapter plug are in an electrically connected position (as shown in FIG. 3). In the embodiments shown in FIGS. 1 and 2, the first reciprocal connector is a female USB Type A connector.

Figure 4:
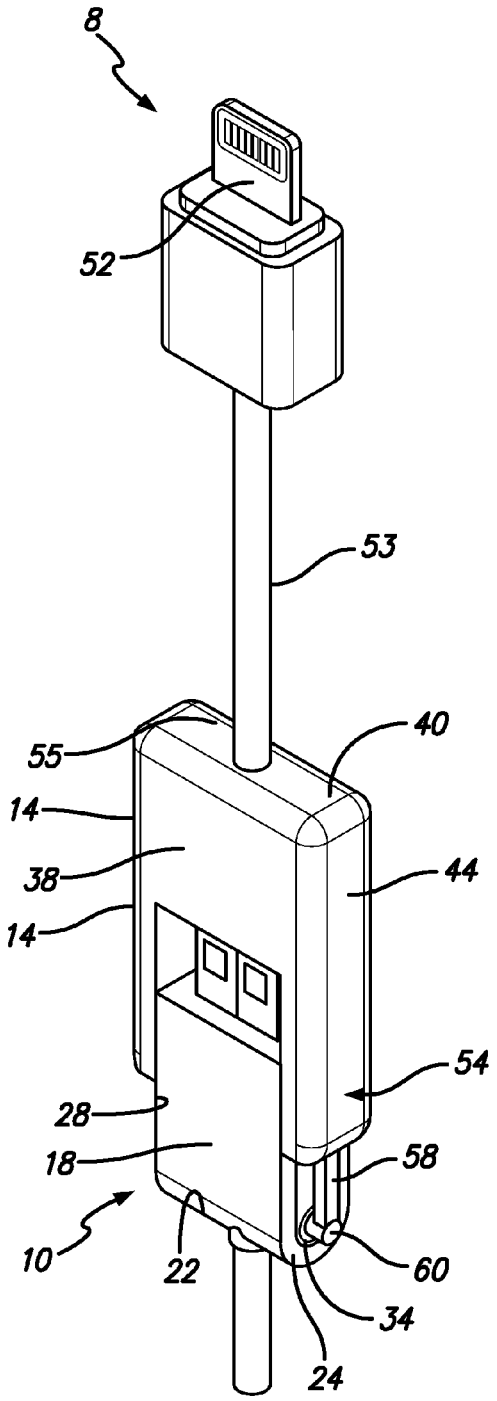
FIG. 4 is a perspective of a third embodiment of a connector cable assembly in accordance with the invention.

A second connector 52, of a different style than the first connector 30, is electrically connected to adapter housing. In the representative embodiment shown in FIGS. 1-3, the second connector is disposed on the first end 40 of the body portion 18 of the adapter housing 38. In alternative aspects, the second connector is flexibly connected to the adapter plug. For example, in the representative embodiment shown in FIG. 4, the second connector is connected to the adapter plug with a flexible cable 53. And in some embodiments, the second connector is connected to the adapter plug with a flexible hinge, such as a flexible neck 55 as shown in FIG. 4. The flexible neck can be comprised of any suitable material including, without limitation, thermoplastic elastomer plastics.

The second connector 52 is electrically connected to the first reciprocal connector 50 by any suitable means, including, without limitation, by circuit boards or terminals (not shown), such that the second connector combines with the first reciprocal connector 50 to form an adapter for the first connector 30. It is another distinct advantage of the invention, that the second connector can be any of a wide variety of connectors. Representative connectors include, without limitation, Lightning connectors, 30-pin connectors, USB connectors, such as USB type A connectors, USB type B connectors, Mini USB connectors, and Micro USB connectors, DC plugs, audio terminals, video terminals, IEEE1394 connectors, HDMI (High-Definition Multimedia Interface) connectors, or connectors for handheld electronic products (such as mobile phones or PDA's), RJ-45 connectors and the like. In the representative embodiments shown in FIGS. 1 and 2, the second connector is a male Lightning connector.

In some aspects, extending axially from the opposing side walls 44 and 46 at the second end 42 of adapter housing 38 is a pair of opposing side arms 54. A pair of pivot arm channels 56 (one shown) extends axially along each side wall and each arm. The pivot channel can have any suitable cross section, such as a polygonal, oval or a circular cross section. In the representative embodiment shown in FIG. 1, the pivot channel has a circular cross section. A pivot arm stop 57 (one shown) having a reduced diameter is formed in the distal end of each side arm.

And in some aspects, a pair of pivot arms 58, each having a first end 60 and second end 62, movably connect the base plug 10 to the adapter plug 14. In some aspects, extending inwardly from the first end 20 of the base 18 is a cylindrical pivot portion 64 (one shown). In a representative embodiment, the cylindrical pivot portion has a length that is substantially the same as the width of the side walls 44 and 46 and a diameter that is substantially the same diameter as the diameter of the pivot opening 34. And in some aspects, the distal end of the pivot portion contains a pivot head 66 (one shown) of enlarged diameter having a circular cross section with a diameter substantially the same as the diameter of the pivot arm holder 36. The pivot arms are pivotally connected to the base plug by positioning the pivot portion in the pivot opening and seating the pivot head in the pivot head holder 36.

In some aspects, the second end 62 of each pivot arm ends with a slide head 68. At least a portion of the slide head has a cross section with dimensions that are substantially the same as the dimensions of the pivot arm slide channels 56. In the representative embodiments shown in FIGS. 1 and 2, the slide head is generally spherical with a diameter substantially the same as the diameter of the cylindrical side channels.

Shown in FIG. 2 is a connector 8 in a disengaged position, while a connector in an engaged position is shown in FIG. 3. As shown in FIG. 2, in the disengaged position, the adapter plug 14 is moved outwardly via the sliding movement of the pivot arms 58 in the pivot channels 36, so that the first connector 30 is free of the first reciprocal connector 50. The adapter plug can then slidably move between the two side arms and turn in different directions via the pivot portions 64, so that the first connector can be connected to an electrical device, such as a personal computer, a tablet, a smart phone, an MP3 player, a radio or the like without having to mechanically disassemble the connector. Alternatively, as shown in FIG. 3, in the engaged position, the adapter housing is pivoted to align the first connector with the first reciprocal connector and the adaptor is then slidably moved towards the base connector to electrically connect the first connector with the first reciprocal connector. In this position, the third connector can be connected to an electrical device.

Figure 6:
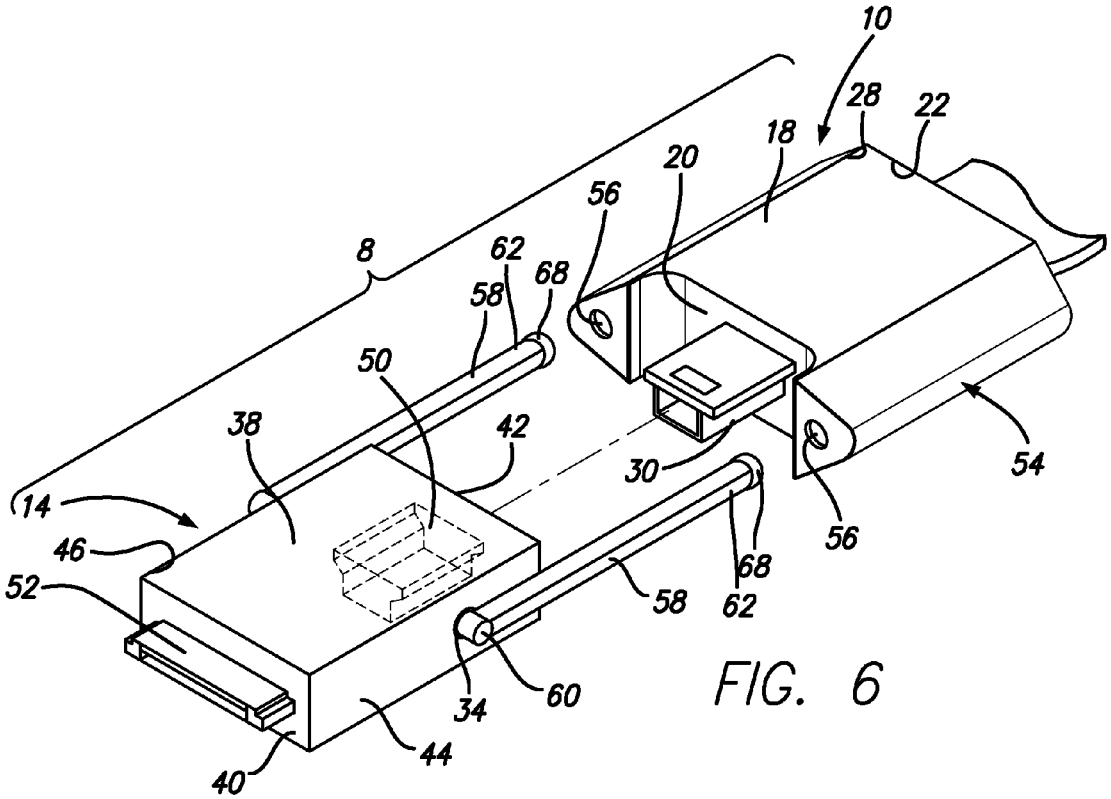
FIG. 6 is an exploded, perspective view of a fifth embodiment of a connector cable assembly in accordance with the invention.

Shown in FIG. 6 is an exploded perspective view of a third representative embodiment of a connector cable assembly in accordance with the invention. In this embodiment, the pair of opposing side arms 58 extends axially from the opposing side walls 44 and 46 at the second end 42 of the adapter plug 14, while the pair of pivot arm channels 56 extends axially along each side wall 24 and 28 at the second end of the base 8. The pair of pivot arms 58 are pivotally connected to the adapter plug by positioning the pivot portion (not shown) in the pivot opening 34 and seating the pivot head (not shown) in the pivot head holder (not shown).

Figure 7:
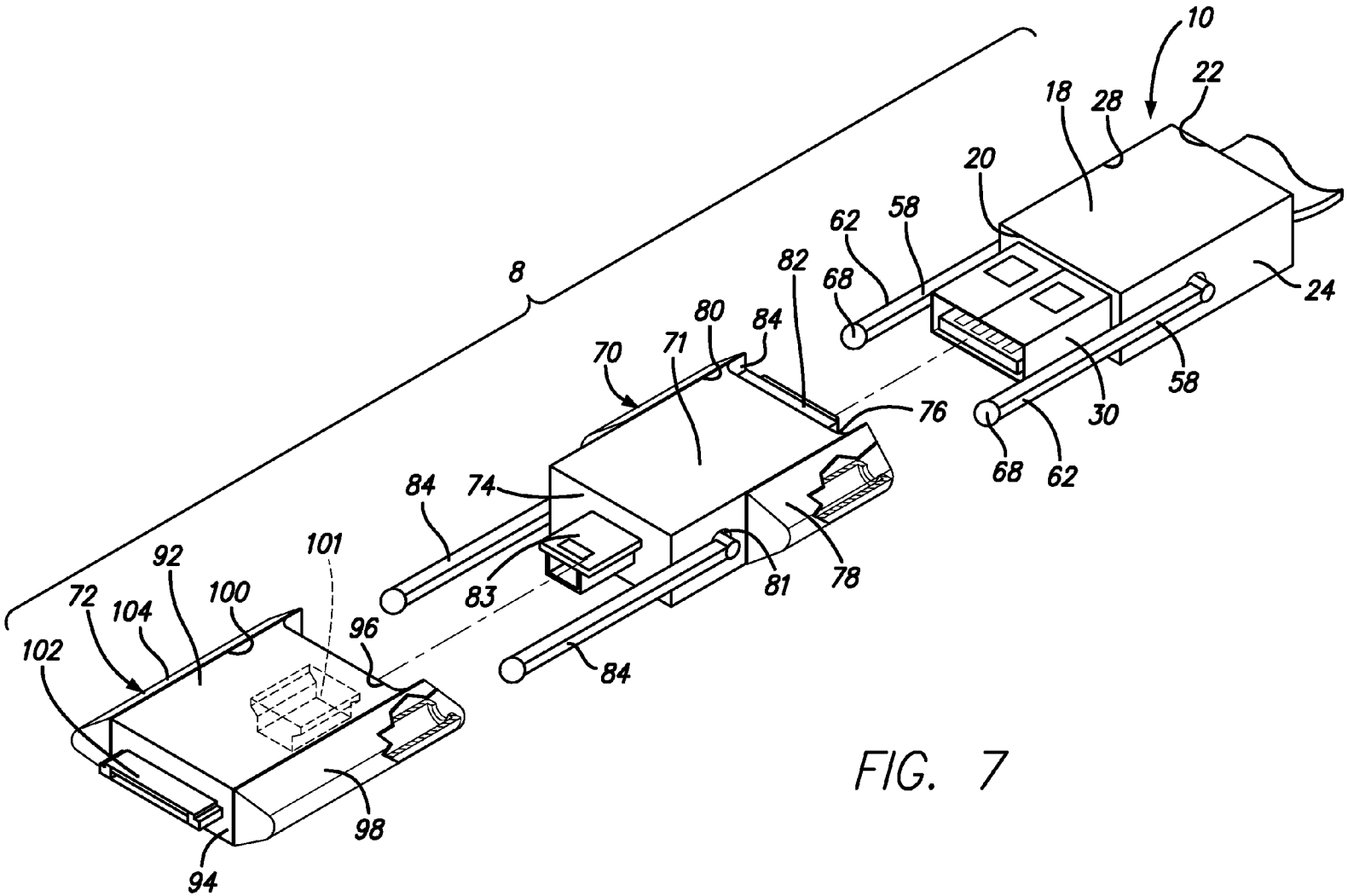
FIG. 7 is an exploded, perspective view of a sixth embodiment of a connector cable assembly in accordance with the invention.

FIG. 7 illustrates an exploded, perspective view of a fourth embodiment of a connector cable assembly 8 in accordance with the invention. In this representative embodiment, the connector comprises a base plug 10, a first adapter plug 70 and a second adapter plug 72. The base plug 10 has a structure that is the same as that of the base plug shown in FIGS. 1-3.

The first adapter plug 70 is made of any suitable material, including insulating materials, such as plastic. In the representative embodiment shown in FIG. 7, the first adapter plug includes a housing 71 having a first end comprising a first end wall 74, a second end comprising a second end wall 76 and opposing sides comprising opposing side walls 78 and 80. A pair of opposing pivot openings 81 (one shown) is disposed in each of the opposing side walls 28 and 30.

A first reciprocal connector 82 is disposed in a second end 76 of the housing 71 of the first adapter plug 70. The first reciprocal connector is adapted to mate with the first connector 30 to achieve an electrical connection when the base plug and the first adapter plug are in an electrically connected position. In the embodiment shown in FIG. 7, the first reciprocal connector is a female USB Type A connector.

A second connector 83, of a different style than the first connector 30, is disposed in the first end 74 of the first adapter housing 72. The second connector is electrically connected to the first reciprocal connector 50 by any suitable means, including, without limitation, by circuit boards or terminals (not shown), such that the second connector combines with the first reciprocal connector 50 to form an adapter for the first connector 30.

Extending axially from the opposing side walls 78 and 80 at the first end 74 of the first adapter is a pair of opposing side arms 84. A pair of pivot arm channels 85 extends axially along each opposing side wall at the second end 76.

Figure 5:
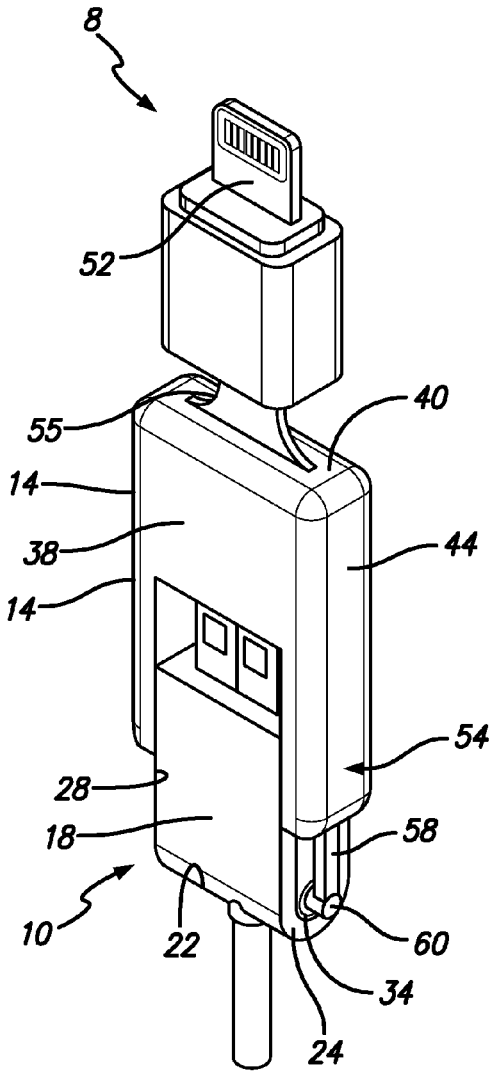
FIG. 5 is a perspective view of a fourth embodiment of a connector cable assembly in accordance with the invention.

The second adapter plug 72 is made of any suitable material, including insulating materials, such as plastic. In the representative embodiment shown in FIG. 5, the second adapter plug includes a housing 92 having a first end comprising a first end wall 94, a second end comprising a second end wall 96 and opposing sides comprising opposing side walls 98 and 100.

A third connector 102, of a different style than the first connector 30 and the second connector 82, is disposed in the first end 94 of the second adapter plug housing 92. The third connector is electrically connected to the second reciprocal connector 100 by any suitable means, including without limitation, by circuit boards or terminals (not shown), such that the second connector, the second reciprocal connector and third connector combines with the first reciprocal connector 50 to form an adapter for the first connector 30.

Extending along the opposing side walls 98 and 100 of the second adapter plug 72 is a pair of opposing pivot arm channels 104. The pair of pivot arms 84 movably connects the first adapter plug 70 to the adapter plug 76. The pivot arms are pivotally connected to the second adapter plug by positioning the pivot portion (not shown) in the pivot opening 34 and seating the pivot head (not shown) in the pivot head holder (not shown).

In the foregoing specification, various aspects of the invention have been described with reference to specific exemplary embodiments. Various modifications and changes may be made, however, without departing from the scope of the present invention. The specification and figures are illustrative, rather than restrictive, and modifications are intended to be included within the scope of the present invention. Accordingly, the scope of the invention should be determined by the claims and their legal equivalents rather than by merely the examples described. With regard to particular embodiments described above, any benefit, advantage, solution to a problem, or any element that may cause any particular benefit, advantage, or solution to occur or to become more pronounced are not to be construed as critical, required, or essential features or components of any or all the claims.

As used herein, the terms "comprise," "comprises," "comprising," "having." "including," "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

We claim:

1. A connector assembly for multiple connectors comprising:

a first connector;

a base plug having a first end, a second end, and first and second opposing sides, the first connector disposed in the first end of the base plug;

a first reciprocal connector configured to mate with the first connector;

an adapter plug having a first end, a second end, and first and second opposing sides, the first reciprocal connector disposed in the second end of the adapter plug;

a second connector, different than the first connector, the second connector electrically connected to the first reciprocal connector; and first and second pivot arms, the first pivot arm pivotally connected to the first side of the base plug and slidably connected to the first side of the adapter plug and the second pivot arm pivotally connected to the second side of the base plug and slidably connected to the first side of the adapter plug, whereby the base plug and the adapter plug are movable between electrically engaged and electrically disengaged positions.

2. The connector assembly of claim 1 wherein the second connector is disposed in the first end of the adapter plug.

3. The connector cable assembly of claim 1 wherein the second connector is flexibly connected to the adapter plug.

4. The connector cable assembly of claim 3 wherein the second connector is connected to the adapter plug with a flexible cable.

5. The connector cable assembly of claim 3 wherein the second connector is connected to the adapter plug with a flexible hinge.

6. The connector cable assembly of claim 5 wherein the flexible hinge is comprised of thermoplastic elastomer material.

7. The connector assembly of claim 1 wherein the first connector is a Lightning connector, a 30-pin connector, a USB connector, a DC plug, an audio terminal, a video terminal, an IEEE1394 connector, a HDMI connector or an RJ-45 connector.

8. The connector assembly of claim 1 wherein the second connector is a Lightning connector, a 30-pin connector, a USB connector, a DC plug, an audio terminal, a video terminal, an IEEE1394 connector, a HDMI connector or an RJ-45 connector.

9. The connector assembly of claim 1 further comprising a second base plug connector, different than the first connector, disposed in the second end of the base plug and electrically connected to the first connector.

10. The connector assembly of claim 9 wherein the second base plug connector is a Lightning connector, a 30-pin connector, a USB connector, a DC plug, an audio terminal, a video terminal, an IEEE1394 connector, a HDMI connector or an RJ-45 connector.

11. The connector assembly of claim 1 wherein the first opposing side of the adapter plug further comprises a first channel slidably receiving the first pivot arm and the second opposing side of the adapter plug further comprises a second channel slidably receiving the second pivot arm.

12. The connector assembly of claim 11 further comprising a first side arm extending axially from the first opposing side at the second end of the adapter plug, where the first slide channel extends along the first side arm, and a second side arm extending axially from the second opposing side of the adapter plug where the second slide channel extends along the first second arm.

13. A connector assembly for multiple connectors comprising:

a first connector;

a base plug having a first end, a second end, and first and second opposing sides, the first connector disposed in the first end of the base plug;

a first reciprocal connector configured to mate with the first connector an adapter plug having a first end, a second end, and first and second opposing sides, the first reciprocal connector disposed in the second end of the adapter plug;

a second connector, different than the first connector, the second connector electrically connected to the first reciprocal connector;

first and second pivot arms, the first pivot arm pivotally connected to the first side of the adapter plug and the second pivot arm pivotally connected to the second side of the adapter plug, a first channel on the first opposing side of the base plug, the first channel slidably, but not pivotally, receiving the first pivot arm and a second channel on the second opposing side of the base plug, the second channel slidably, but not pivotally, receiving the second pivot arm.

14. The connector assembly of claim 13 wherein the second connector is disposed in the first end of the adapter plug.

15. The connector cable assembly of claim 13 wherein the second connector is flexibly connected to the adapter plug.

16. The connector cable assembly of claim 15 wherein the second connector is connected to the adapter plug with a flexible cable.

17. The connector cable assembly of claim 15 wherein the second connector is connected to the adapter plug with a flexible hinge.

18. The connector cable assembly of claim 17 wherein the flexible hinge is comprised of a thermoplastic elastomer material.

19. The connector assembly of claim 13 wherein the first connector is a Lightning connector, a 30-pin connector, a USB connector, a DC plug, an audio terminal, a video terminal, an IEEE1394 connector, a HDMI connector or an RJ-45 connector.

20. The connector assembly of claim 13 wherein the second connector is a Lightning connector, a 30-pin connector, a USB connector, a DC plug, an audio terminal, a video terminal, an IEEE1394 connector, a HDMI connector or an RJ-45 connector.

21. The connector assembly of claim 13 further comprising a second base plug connector, different than the first connector, is disposed in the second end of the base plug and electrically connected to the first connector.

22. The connector assembly of claim 21 wherein the second base plug connector is a Lightning connector, a 30-pin connector, a USB connector, a DC plug, an audio terminal, a video terminal, an IEEE1394 connector, a HDMI connector or an RJ-45 connector.

23. The connector assembly of claim 13 wherein the first connector is a Lightning connector, a 30-pin connector, a USB connector, a DC plug, an audio terminal, a video terminal, an IEEE1394 connectors, a HDMI connector or an RJ-45 connector.

24. The connector assembly of claim 13 further comprising a first side arm extending axially from the first opposing side at the second end of the base plug, where the first slide channel extends along the first side arm, and a second side arm extending axially from the second opposing side of the base plug, where the second slide channel extends along the first second arm.

25. A connector assembly for multiple connectors comprising:

a first connector;

a base plug having a first end, a second end, and first and second opposing sides, the first connector disposed in the first end of the base plug;

a first reciprocal connector configured to mate with the first connector;

a first adapter plug having a first end, a second end, and first and second opposing sides, the first reciprocal connector disposed in the second end of the first adapter plug;

a second connector, different than the first connector, the second connector disposed in the first end of the first adapter plug and the second connector electrically connected to the first reciprocal connector;

a second adapter plug having a first end, a second end, and first and second opposing sides, a second reciprocal connector configured to mate with the second connector, the second reciprocal connector disposed in the second end of the second adapter plug;

a third connector, different than the first and second connectors, the third connector electrically connected to the second reciprocal connector;

a first pair of first and second pivot arms, the first pivot arm pivotally connected to the first side of the base plug and slidably connected to the first side of the first adapter plug and the second pivot arm pivotally connected to the second side of the base plug and slidably connected to the second side of the first adapter plug, whereby the base plug and the first adapter plug are movable between electrically engaged and electrically disengaged positions; and a second pair of first and second pivot arms, the first pivot arm pivotally connected to the first side of the first adapter plug and slidably connected to the first side of the second adapter plug and the second pivot arm pivotally connected to the second side of the first adapter plug and slidably connected to the second side of the second adapter plug, whereby the first adapter plug and the second adapter plug are movable between electrically engaged and electrically disengaged positions.

26. The connector assembly of claim 25 wherein the second connector is disposed in the first end of the second adapter plug.

27. The connector cable assembly of claim 25 wherein the second connector is flexibly connected to the second adapter plug.

28. The connector cable assembly of claim 27 wherein the second connector is connected to the second adapter plug with a flexible cable.

29. The connector cable assembly of claim 27 wherein the second connector is connected to the second adapter plug with a flexible hinge.

30. The connector cable assembly of claim 27 wherein the flexible hinge is comprised of an elastomeric material.

31. The connector cable of claim 25 wherein the first connector, second connector and third connector are each a Lightning connector, a 30-pin connector, a USB connector, a DC plug, an audio terminal, a video terminal, an IEEE1394 connector, a HDMI connector or an RJ-45 connector and are each different from one another.

32. The connector assembly of claim 25 further comprising a second base plug connector disposed in the second end of the base plug and electrically connected to the first connector.

33. The connector assembly of claim 32 wherein the second base plug connector is a Lightning connector, a 30-pin connector, a USB connector, a DC plug, an audio terminal, a video terminal, an IEEE1394 connector, a HDMI connector or an RJ-45 connector.

34. The connector assembly of claim 25 wherein the first opposing side of the base plug further comprises a first channel slidably receiving the first pivot arm and the second opposing side of the base plug further comprise a second channel slidably receiving the second pivot arm of the first pair of pivot arms and the first opposing side of the first adapter plug further comprises a first channel slidably receiving the first pivot arm and the second opposing side of the first adapter plug further comprise a second channel slidably receiving the second pivot arm of the second pair of pivot arms.

35. The connector assembly of claim 34 further comprising a first side arm extending axially from the first opposing side at the second end of the first adapter plug, where the first slide channel extends along the first side arm, and a second side arm extending axially from the second opposing side of the first adapter plug where the second slide channel extends along the second side arm and a first side arm extending axially from the first opposing side at the second end of the second adapter plug, where the first slide channel extends along the first side arm, and a second side arm extending axially from the second opposing side of the second adapter plug, where the second slide channel extends along the second side arm.

36. A connector assembly for multiple connectors comprising:

a first connector;

a base plug having a first end, a second end, and first and second opposing sides, the first connector disposed in the first end of the base plug;

a first reciprocal connector configured to mate with the first connector;

a first adapter plug having a first end, a second end, and first and second opposing sides, the first reciprocal connector disposed in the second end of the first adapter plug;

a second connector, different than the first connector, the second connector disposed in the first end of the first adapter plug and the second connector electrically connected to the first reciprocal connector;

a second adapter plug having a first end, a second end, and first and second opposing sides, a second reciprocal connector configured to mate with the second connector, the second reciprocal connector disposed in the second end of the second adapter plug;

a third connector, different than the first and second connectors, the third connector electrically connected to the second reciprocal connector;

a first pair of first and second pivot arms, the first pivot arm pivotally connected to the first side of the first adapter plug and the second pivot arm pivotally connected to the second side of the first adapter plug, a first channel on the first opposing side of the base plug, the first channel slidably, but not pivotally, receiving the first pivot arm;

a second channel on the second opposing side of the base plug, the second channel slidably, but not pivotally, receiving the second pivot arm; whereby the base plug and the first adapter plug are movable between electrically engaged and electrically disengaged positions and a second pair of first and second pivot arms, the first pivot arm pivotally connected to the first side of the second adapter plug and the second pivot arm pivotally connected to the second side of the first second adapter plug, a first channel on the first opposing side of the first adapter plug, the first channel slidably, but not pivotally, receiving the first pivot arm and a second channel on the second opposing side of the first adapter plug, the second channel slidably, but not pivotally, receiving the second pivot arm, whereby the first adapter plug and the second adapter plug are movable between electrically engaged and electrically disengaged positions.

37. The connector assembly of claim 36 wherein the second connector is disposed in the first end of the second adapter plug.

38. The connector cable assembly of claim 36 wherein the second connector is flexibly connected to the second adapter plug.

39. The connector cable assembly of claim 38 wherein the second connector is connected to the second adapter plug with a flexible cable.

40. The connector cable assembly of claim 38 wherein the second connector is connected to the second adapter plug with a flexible hinge.

41. The connector cable assembly of claim 38 wherein the flexible hinge is comprised of an elastomeric material.

* * * * *